US005975036A

United States Patent [19]

Hayashi et al.

[11] Patent Number: 5,975,036

[45] Date of Patent: Nov. 2, 1999

[54] VARIABLE VALVE ACTUATION APPARATUS

[75] Inventors: Nobutaka Hayashi; Takanori Sawada, both of Kanagawa, Japan

[73] Assignee: Unisia Jecs Corporation, Atsugi, Japan

[21] Appl. No.: 09/108,379

[22] Filed: Jul. 1, 1998

[30] Foreign Application Priority Data

Jul. 1, 1997 [JP] Japan ..... 9-175621

[51] Int. Cl.[6] ..... F01L 13/00

[52] U.S. Cl. ..... 123/90.16; 123/90.36

[58] Field of Search ..... 123/90.15, 90.16, 123/90.17, 90.22, 90.33, 90.36, 90.39, 90.4, 90.41, 90.44

[56] References Cited

U.S. PATENT DOCUMENTS

| | | | |
|---|---|---|---|
| 4,151,817 | 5/1979 | Mueller | 123/90.16 |
| 5,203,289 | 4/1993 | Hara et al. | 123/90.16 |
| 5,297,516 | 3/1994 | Hara | 123/90.16 |
| 5,570,664 | 11/1996 | Nohara | 123/90.36 |
| 5,701,857 | 12/1997 | Hara | 123/90.16 |
| 5,794,576 | 8/1998 | Hara et al. | 123/90.16 |

FOREIGN PATENT DOCUMENTS

| | | |
|---|---|---|
| 0 305 693 | 3/1989 | European Pat. Off. . |
| 27 53 197 | 6/1978 | Germany . |
| 197 06 769 | 11/1997 | Germany . |
| 2 273 743 | 6/1994 | United Kingdom . |

*Primary Examiner*—Weilun Lo
*Attorney, Agent, or Firm*—Foley & Lardner

[57] ABSTRACT

A variable valve actuation apparatus for engine cylinder valves comprises a main rocker arm having an end portion for driving association with a cylinder valve. The main rocker arm supports a sub-rocker arm. A lost motion mechanism is between the main rocker and sub-rocker arms. The main rocker arm is formed with a plunger seat. The plunger seat includes a bearing surface on which a plunger of the lost motion mechanism rests. Further, the plunger seat includes gutters for discharging lubricant oil.

6 Claims, 4 Drawing Sheets

VARIABLE VALVE ACTUATION APPARATUS

FIELD OF THE INVENTION

The present invention relates to a variable valve actuation (VVA) apparatus for operation of cylinder valves of an internal combustion engine.

BACKGROUND OF THE INVENTION

U.S. Patent No. 5,297,516, issued on Mar. 29, 1994 discloses a VVA apparatus that employs a main rocker shaft supporting a main rocker arm. The main rocker arm supports a sub-rocker shaft for a sub-rocker arm. A lost motion mechanism disposed between the main rocker arm and the sub-rocker arm is operable unless a lever on the main rocker arm is locking engagement with the sub-rocker arm. The lost motion mechanism includes a spring-biased plunger that rests on an exposed portion of the main rocker shaft. According to this known apparatus, the cylindrical outer peripheral surface of the main rocker shaft serves as a plunger seat and thus the main rocker arm is not formed with any appropriately designed plunger seat for the lost motion mechanism.

An object of the present invention is to improve the variable valve actuation apparatus according to the prior art such that the cylindrical outer peripheral surface of the main rocker shaft is not used as a plunger seat for the lost motion mechanism.

SUMMARY OF THE INVENTION

According to the present invention, a variable valve actuation apparatus comprising:

- a main rocker arm having an end portion for driving association with a cylinder valve of an engine;
- a sub-rocker arm supported by said main rocker arm; and
- a lost motion mechanism between said main rocker arm and said sub-rocker arm, said lost motion mechanism including a lost motion plunger;
- wherein said main rocker arm is formed with a plunger seat that includes a bearing surface on which said plunger rests,
- wherein said plunger seat includes at least one gutter for discharging lubricant oil.

DESCRIPTION OF THE PREFERRED EMBODIMENTS

Referring to FIGS. 1 to 4, the preferred embodiment of a variable valve actuation (VVA) apparatus is described. In the preferred embodiment, the present invention is applied to cylinder valves of an internal combustion engine. In the following description, the cylinder valves are in the form of intake valves although they may be exhaust valves.

Figure 2:
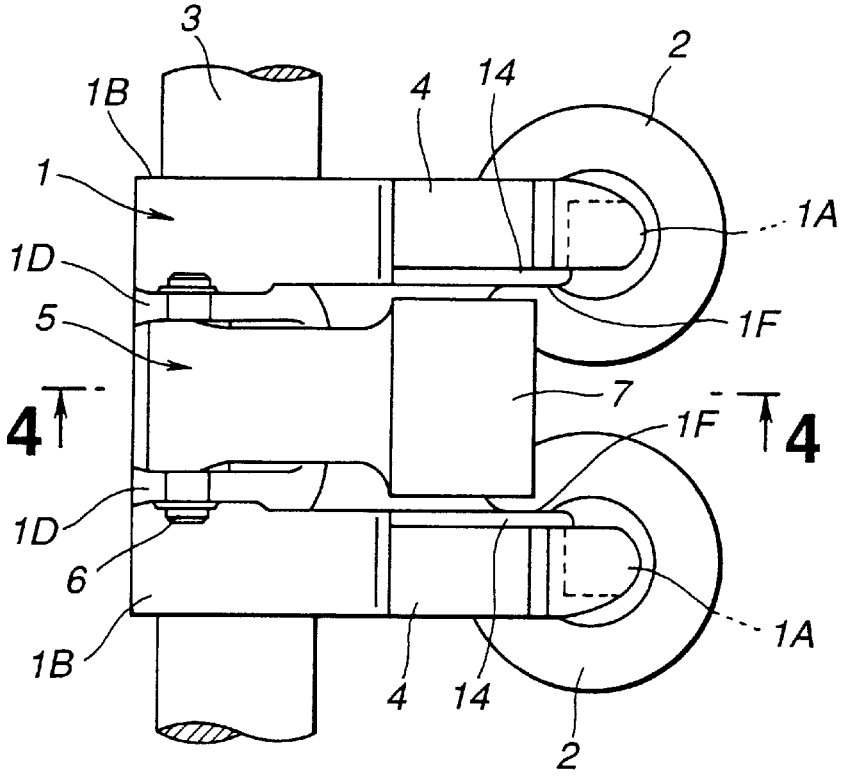
FIG. 2 is a top plan view of the variable valve actuation apparatus.

FIG. 2 illustrates a plan view of the VVA apparatus for operation of two intake valves 2, 2 that are provided per cylinder of an internal combustion engine. The VVA apparatus comprises a single main rocker arm 1. As viewed in the plan view, the main rocker arm 1 is bifurcated. The main rocker arm 1 includes a base structure 1B. The base structure 1B includes a sleeve portion receiving a hollowed main rocker shaft 3 for the main rocker arm 1 to pivot about an axis of the main rocker shaft 3. Cam bearings on a cylinder head of the engine support the main rocker shaft 3 such that it extends along a longitudinal line of the cylinder head. Two rails or arms 1E. 1E have one ends connected to and extend from the sleeve portion of the base structure 1B and opposite free end portions 1A, 1A in driving contact with top ends of stems 2A, 2A of two intake valves 2, 2, respectively. At a middle point between one and opposite ends 1A and 2A, each of the rails 1E, 1E has a low-speed cam follower 4. The low-speed cam followers 4 are adapted for cooperation with two low-speed cams 10, 10, respectively, which have a cam lobe so profiled as to provide a desired valve timing and lift of intake valves 2, 2 for operation of engine at low speeds. The two rails 1E, 1E have inner mutually facing spaced parallel walls 1F, 1F, which are partially recessed to define oil guides or passageways 14, 14.

A pair of parallel spaced support walls 1D, 1D extends outwardly from the sleeve portion of the base structure 1B of the rocker arm 1. A sub-rocker shaft 6 extends through a hub portion of a sub-rocker arm 5 and has opposite end portions held in the support walls 1D, 1D, respectively. This allows the sub-rocker arm 5 to pivot about an axis of the sub-rocker shaft 6. During the pivotal motion, the sub-rocker arm 5 travels through a space between the two rails 1E, 1E. As best seen in FIG. 2, adjacent its leading end, the sub-rocker arm 5 has a high-speed cam follower 7. The high-speed cam follower 7 is adapted for cooperation with a high-speed cam 9, which has a cam lobe so profiled as to provide a desired valve timing and lift of intake valves 2, 2 for operation of engine at high speeds. As shown in FIG. 2, the high-speed cam follower 7 and two low-speed cam followers 4, 4 are arranged side by side along a longitudinal line of the main rocker shaft 3 that is arranged in parallel with the camshaft 8. The high-speed cam 9 and low-speed cams 10 are fixed to the camshaft 8 for rotation therewith. The high-speed cam follower 7 and the low-speed cam followers 4, 4 are in bearing contact with the high-speed cam 9 and the low-speed cams 10, 10, respectively, so that rotating the camshaft 8 causes the main rocker arm 1 and the sub-rocker arms 5, 5 to pivot.

Figure 1:
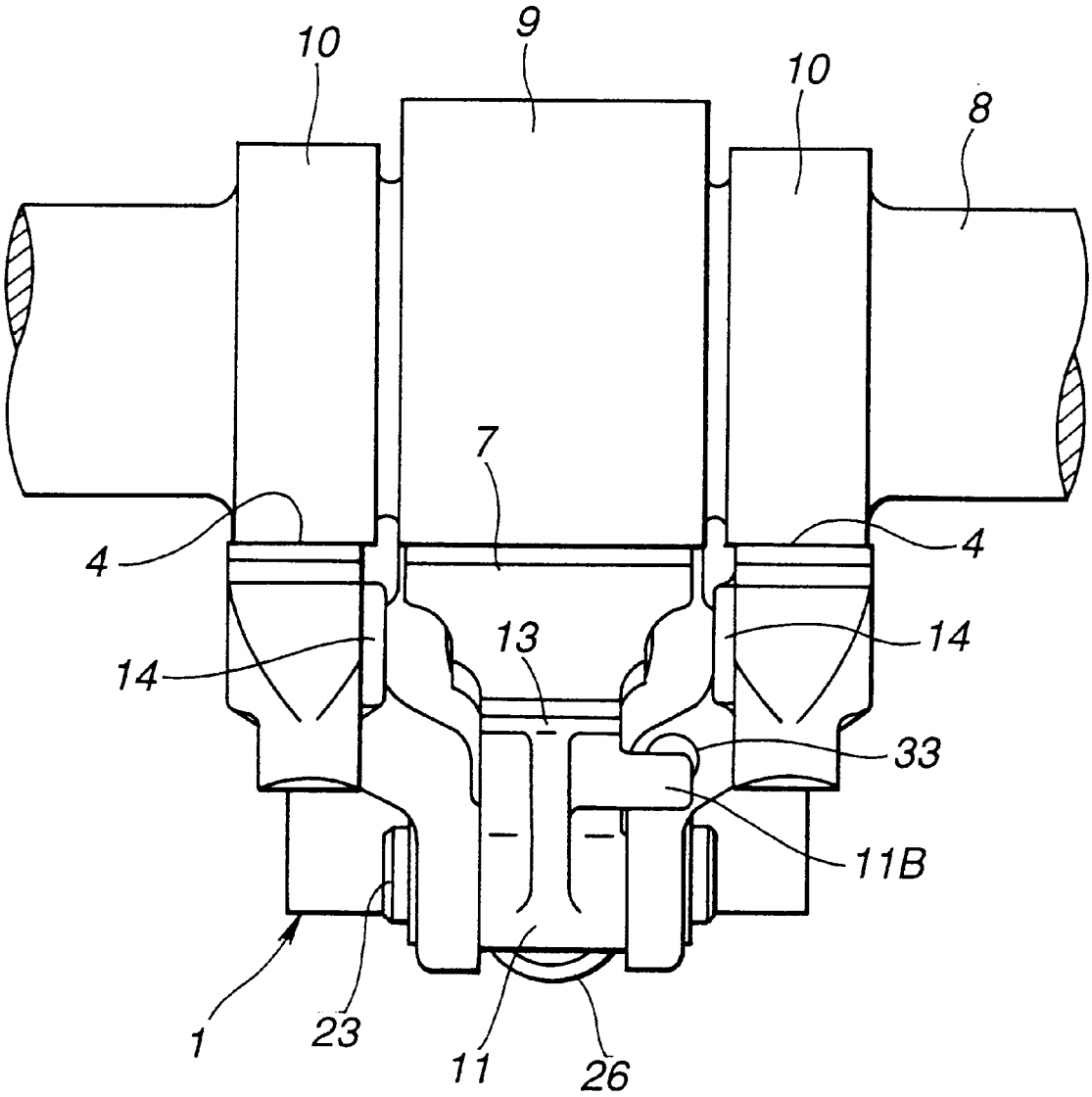
FIG. 1 illustrates a portion of a cylinder head of an internal combustion engine with a variable valve actuation apparatus according to the present invention.
Figure 4:
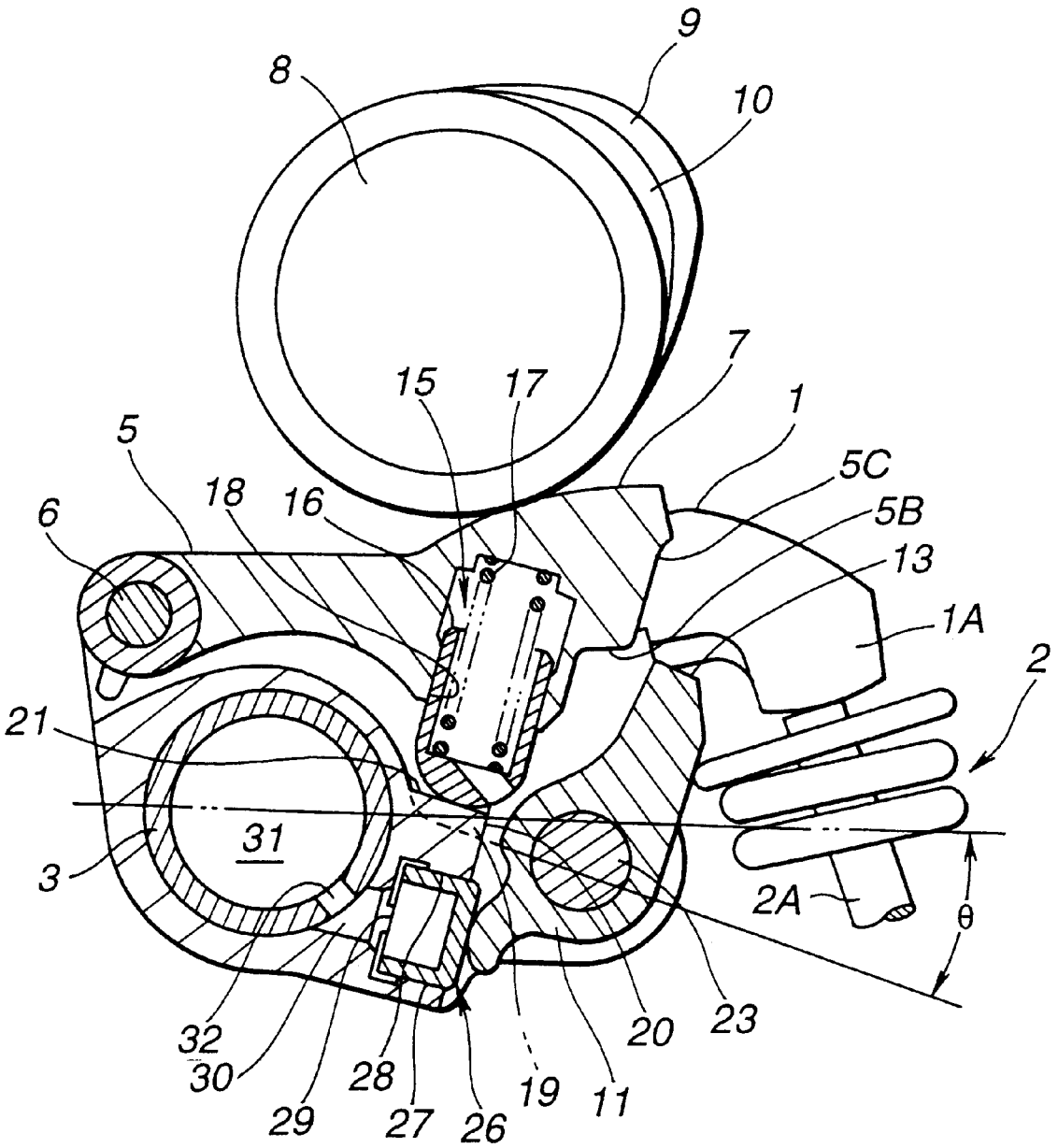
FIG. 4 is a sectional view taken along the line 4—4 in FIG. 2.

Viewing in FIGS. 1 and 4, a lubrication oil supply pipe, not shown, is arranged above the camshaft 8 to supply the high-speed and low-speed cams 9, 10, 10 with lubrication oil. The lubrication oil thus supplied makes oil film between the high-speed cam 9 and the high-speed cam follower 7 and between each of low-speed cams 10, 10 and the adjacent one of the low-speed cam followers 4, 4. The lubrication oil is guided also to the oil passageways 14, 14 with which the main rocker arm 1 is formed.

Figure 3:
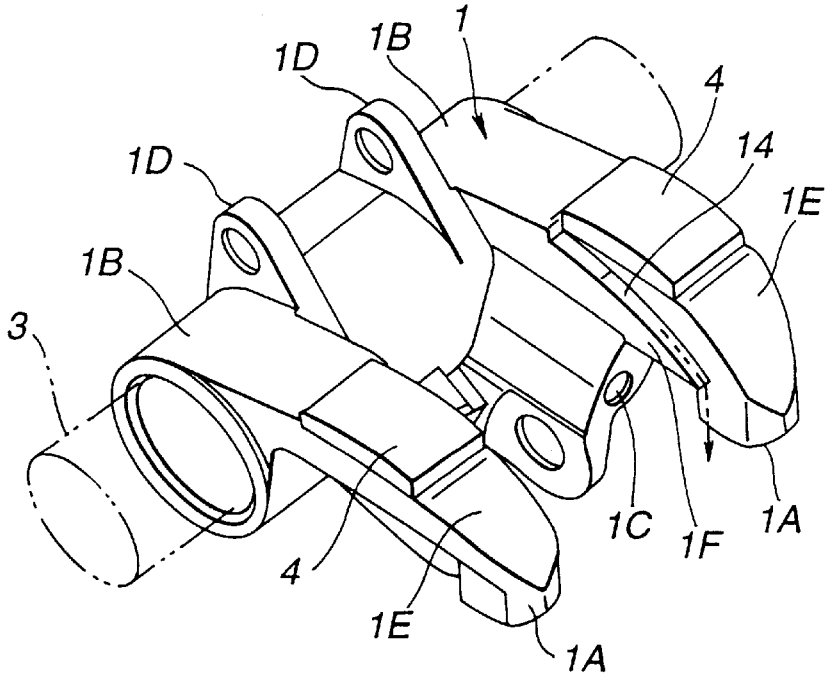
FIG. 3 is a perspective plan view of a main rocker arm of the variable valve actuation apparatus.

As readily seen from FIGS. 2 and 3, the passageways 14, 14 extend along the inner walls 1F, 1F and inclined downward toward the tops of stems 2A, 2A of the intake valves 2, 2. An arrow shows flow of lubricant oil along each of the passageways 14, 14.

The sub-rocker arm 5 does not have any portion arranged to abut the intake valves 2, 2. The high-speed cam follower 7 on the sub-rocker arm 5 protrudes to define a part cylindrical surface.

In order to reduce a distance between the main rocker shaft 3 and the stems 2A, the main rocker arm 5 is recessed inwardly to define a space 11A, which accommodates the sub-rocker arm 5 and a lever 11, until the main rocker shaft 3 is partially exposed. This allows miniaturization of the main rocker arm 1.

As best seen in FIG. 4, at its lower side, the sub-rocker arm 5 is equipped with a lost motion mechanism 15. The lost motion mechanism 15 includes a lost motion plunger 16 and a lost motion spring 17. The sub-rocker arm 5 is recessed inwardly from its lower surface to form a bore 18 that receives the lost motion mechanism 15. At its one end, the lost motion spring 17 bears against a closed end of the bore 18, and at its opposite end, it bears against the lost motion plunger 16. Specifically, this plunger 16 is in the form of a cylindrical spring retainer formed with a blind ended bore, and the opposite end of the lost motion spring 17 bears against a closed end of this blind ended bore. This arrangement resiliently biases the plunger 16 outwardly of the bore 18.

Figure 5:
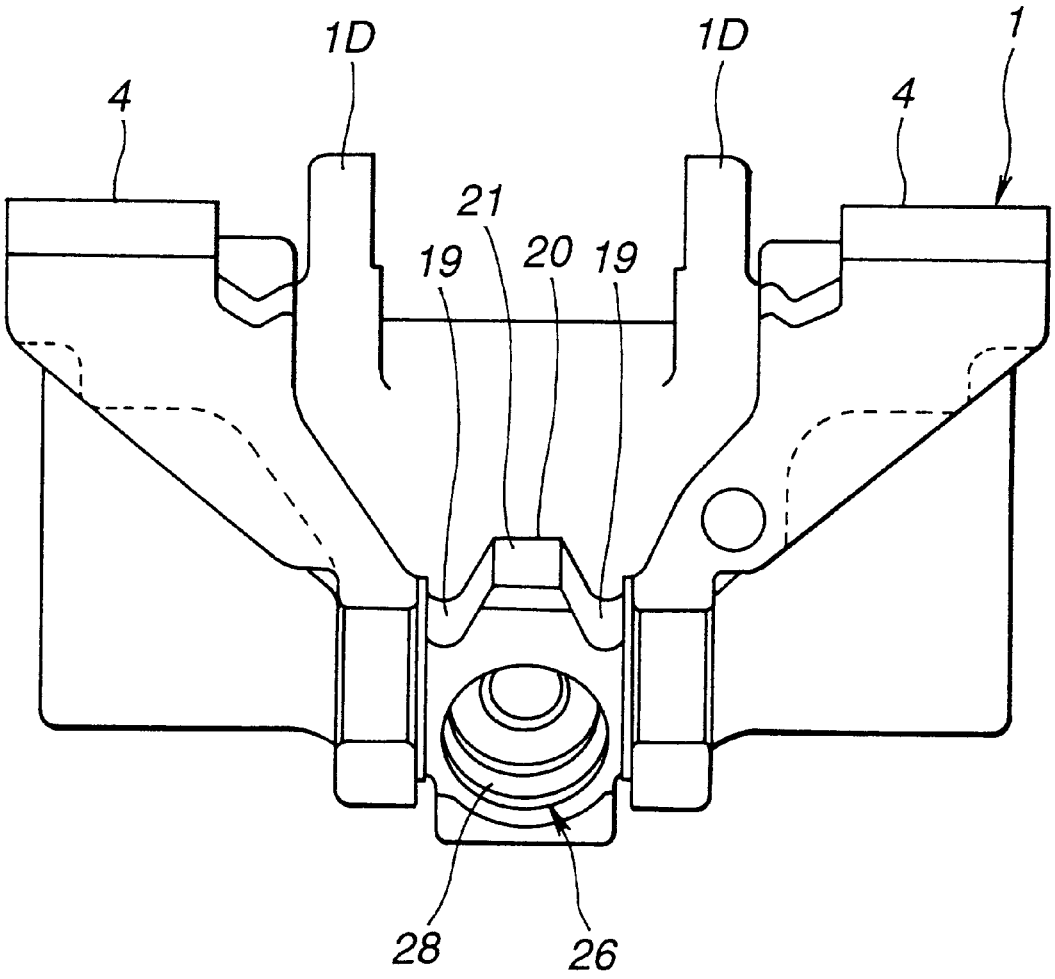
FIG. 5 is a front plane view of the main rocker arm.

As best seen in FIG. 5, the main rocker arm 1 is formed with a plunger seat 20. The plunger seat 20 has a bearing surface 21, which a leading end or closed end of the lost motion plunger 16 rests on, and at least one gutter, two gutters 19 in this embodiment. In the case where a single gutter 19 is employed, the gutter 19 runs along a side of the bearing surface 21. In the case where two gutters 19, 19 are used, the gutters 19, 19 run along spaced one and opposite sides of the bearing surface 21 as best seen in FIG. 5. FIG. 4 illustrates the position of parts when the intake valve 2 is in its zero lift position to assume its closed position. Viewing in FIG. 4, each gutter 19 extends away from the main rocker shaft 3 and a bottom wall of the gutter 19 is inclined downwardly through a predetermined angle θ with respect to a horizontal plane. Preferably, the inclined angle θ is in the neighborhood of 20 degrees.

With the above arrangement, lubricating oil forms oil film between each low-speed cam 10 and cam follower 4 and between the high-sped cam 8 and cam follower 7. Subsequently, the lubricating oil runs along the main rocker arm 1. A portion of the lubricating oil moves along the bearing surface 21 of the plunger seat 20, while most of the other portion thereof moves along the gutters 19, 19. Thus, contaminants are removed owing to rapid streams of the lubricating oil along the gutters 19, 19, preventing the contaminants from accumulating on the bearing surface 21.

As shown in FIG. 4, the sub-rocker arm 5 is recessed inwardly toward the lost motion mechanism 15 to define a shoulder 5B and a slope 5C. The shoulder 5B is disposed below the high-speed cam follower 7 for catching an upper end portion 13 of the lever 11. The slope 5C connects with the shoulder 5B to guide the upper end portion 13 of the lever 11.

A pin 23 that is mounted to the main rocker arm 1 supports the lever 11. The lever 11 has a laterally extending portion 11B from a portion immediately below the upper end portion 13 (see FIG. 1). A plunger 33 is received in a cylindrical recess 1C (see FIG. 3) with a return spring, not shown, disposed behind the plunger 33 and the bottom of the cylindrical recess 1C. Owing to the action of the return spring, the plunger 33 is in abutting engagement with the laterally extending portion 11B.

Viewing in FIG. 4, at its lower end, the lever 11 is in abutting engagement with a plunger 27 of a hydraulic driver 26. With regard to the hydraulic driver 26, the main rocker arm 1 is recessed inwardly toward the main rocker shaft 3 to define a cylindrical bore 28. This bore 28 receives the plunger 27. The plunger 27 defines in the bore 28 a hydraulic chamber 29. Drilling through wall separating the hydraulic chamber 29 from the main rocker shaft 3 forms a passage 32. This passage 32 has one end opening to the hydraulic chamber 29 and the opposite end facing the main rocker shaft 3.

The main rocker shaft 3 is hollowed to form an oil gallery 31. This oil gallery 31 extends in the longitudinal direction of the main rocker shaft 3. The main rocker shaft 3 is formed with a port 32 that provides communication between the oil gallery 31 and the passage 32.

In operation, the oil passageways 14 convey lubricant oil to the tops of the stems 2A, 2A, forming oil films between the tops and the adjacent end portion 1A, 1A of the main rocker arm 1. Thus, additional arrangement for lubricating the tops of the stems 2A, 2A is not needed.

Further, the gutters 19, 19 induce streams of lubricant oil that discharge contaminants which otherwise would accumulate on the bearing surface 21. It is confirmed that such gutter or gutters adjacent the bearing surface 21 prove to be effective in preventing accumulation of contaminants on the bearing surface 21.

Since accumulation of contaminants on the bearing surface 21 is prevented by the provision of the gutters 19, 19, occurrence of phenomena like scuffing and pitching is prevented. It is considered that such phenomena occur owing to presence of contaminants between the bearing surface and the lost motion plunger. Further, it is allowed to finish the bearing surface by milling.

Operation of the VVA apparatus that has been described may be understood by making reference to disclosure of U.S. Pat. No. 5,297,516, issued on Mar. 29, 1994, which has been incorporated herein by reference in its entirety.

What is claimed is:

1. A variable valve actuation apparatus for cylinder valves of an engine, comprising:

a main rocker arm having an end portion for driving association with a cylinder valve;

a sub-rocker arm supported by said main rocker arm; and a lost motion mechanism between said main rocker arm and said sub-rocker arm, said lost motion mechanism including a lost motion plunger;

wherein said main rocker arm is formed with a plunger seat that includes a bearing surface on which said plunger rests, wherein said plunger seat includes at least one gutter for discharging lubricant oil.

2. A variable valve actuation apparatus as claimed in claim 1, wherein said gutter runs along a side of said bearing surface.

3. A variable valve actuation apparatus as claimed in claim 1, wherein said plunger seat includes two such gutters, each running along two spaced sides of said bearing surface.

4. A variable valve actuation apparatus as claimed in claim 1, wherein, when mounted on the engine, said gutter is so inclined as to allow discharge of lubricant oil downwardly when the associated valve is in its no lift position.

5. A variable valve actuation apparatus as claimed in claim 4, wherein said gutter has a bottom that is inclined through a predetermined angle with respect to a horizontal plane, said predetermined angle being in the neighborhood of 20 degrees.

6. A variable valve actuation apparatus as claimed in claim 1, further comprising a lever supported by said main rocker arm and is operative to pivot into driving engagement with said sub-rocker arm to provide positive drive connection from said sub-rocker arm to said main rocker arm via said lever.

* * * * *